US009738849B2

(12) United States Patent
Barton et al.

(10) Patent No.: US 9,738,849 B2
(45) **Date of Patent: *Aug. 22, 2017**

(54) LUBRICATING COMPOSITION CONTAINING AN ANTIWEAR AGENT

(71) Applicant: The Lubrizol Corporation, Wickliffe, OH (US)

(72) Inventors: William R. S. Barton, Belper (GB); Mark C. Davies, Shanghai (CN); Michael R. Sutton, Belper (GB); Matthew D. Gieselman, Wickliffe, OH (US); Patrick E. Mosier, Bay Village, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/051,985

(22) Filed: Feb. 24, 2016

(65) Prior Publication Data

US 2016/0168503 A1 Jun. 16, 2016

Related U.S. Application Data

(63) Continuation of application No. 13/389,517, filed as application No. PCT/US2010/045154 on Aug. 11, 2010, now abandoned.

(60) Provisional application No. 61/234,721, filed on Aug. 18, 2009.

(51) Int. Cl.

| | |
|---|---|
| ***C10M 137/10*** | (2006.01) |
| ***C09K 15/32*** | (2006.01) |
| ***C10M 141/10*** | (2006.01) |
| ***C10M 129/44*** | (2006.01) |
| ***C10M 133/44*** | (2006.01) |
| ***C10M 135/10*** | (2006.01) |
| ***C10M 137/04*** | (2006.01) |

(52) U.S. Cl.

CPC ..... *C10M 141/10* (2013.01); *C10M 129/44* (2013.01); *C10M 133/44* (2013.01); *C10M 135/10* (2013.01); *C10M 137/04* (2013.01); *C10M 137/10* (2013.01); *C10M 2207/028* (2013.01); *C10M 2207/042* (2013.01); *C10M 2207/124* (2013.01); *C10M 2207/128* (2013.01); *C10M 2207/24* (2013.01); *C10M 2207/262* (2013.01); *C10M 2207/281* (2013.01); *C10M 2207/282* (2013.01); *C10M 2207/283* (2013.01); *C10M 2207/289* (2013.01); *C10M 2215/02* (2013.01); *C10M 2215/08* (2013.01); *C10M 2215/082* (2013.01); *C10M 2215/086* (2013.01); *C10M 2215/223* (2013.01); *C10M 2215/224* (2013.01); *C10M 2215/28* (2013.01); *C10M 2219/046* (2013.01); *C10M 2219/089* (2013.01); *C10M 2223/043* (2013.01); *C10M 2223/045* (2013.01); *C10M 2223/049* (2013.01); *C10N 2230/06* (2013.01); *C10N 2230/42* (2013.01); *C10N 2230/43* (2013.01); *C10N 2230/45* (2013.01); *C10N 2240/10* (2013.01)

(58) Field of Classification Search

None

See application file for complete search history.

(56) References Cited

U.S. PATENT DOCUMENTS

| | | | | |
|---|---|---|---|---|
| 2,796,400 | A | 6/1957 | Thornley | |
| 4,237,022 | A * | 12/1980 | Barrer | C07D 207/416 252/392 |
| 5,338,470 | A | 8/1994 | Hiebert | |
| 5,583,100 | A | 12/1996 | Okamoto et al. | |
| 2005/0198894 | A1* | 9/2005 | Migdal | C10L 1/19 44/388 |
| 2006/0102691 | A1* | 5/2006 | Toyama | B23K 1/0012 228/101 |

FOREIGN PATENT DOCUMENTS

| | | | |
|---|---|---|---|
| FR | 2512458 | | 3/1983 |
| WO | 2005/087904 | A1 | 9/2005 |
| WO | 2007/044820 | A1 | 4/2007 |
| WO | 2008/070307 | A1 | 6/2008 |
| WO | 2008/076825 | A1 | 6/2008 |
| WO | 2008/147700 | A1 | 12/2008 |
| WO | 2008/147701 | A1 | 12/2008 |
| WO | 2008/147704 | A1 | 12/2008 |
| WO | 2010/096286 | A1 | 8/2010 |
| WO | 2010/132318 | A1 | 11/2010 |
| WO | 2011/022263 | A1 | 2/2011 |

* cited by examiner

*Primary Examiner* — Vishal Vasisth

(74) *Attorney, Agent, or Firm* — Michele M. Tyrpak; Christopher D. Hilker; Teresan W. Gilbert

(57) ABSTRACT

The invention provides a lubricating composition containing (a) an oil of lubricating viscosity, (b) a phosphite having at least one hydrocarbyl group that has 4 or more carbon atoms, and (c) a compound derived from a hydroxy-carboxylic acid. The invention further relates to the use of the lubricating composition in an internal combustion engine.

13 Claims, No Drawings

LUBRICATING COMPOSITION CONTAINING AN ANTIWEAR AGENT

CROSS REFERENCE

This application is a CON of Ser. No. 13/389,517 filed Apr. 18, 2012, now abandoned which is a 371 of PCT/US2010/045154 filed Aug. 11, 2010, which claims benefit of 61/234,721 filed Aug. 18, 2009.

FIELD OF INVENTION

The invention provides a lubricating composition containing (a) an oil of lubricating viscosity, (b) a phosphite having at least one hydrocarbyl group that has 4 or more carbon atoms, and (c) a compound derived from a hydroxy-carboxylic acid. The invention further relates to the use of the lubricating composition in an internal combustion engine. The internal combustion engine may have surfaces of an aluminium alloy, or aluminium composite.

BACKGROUND OF THE INVENTION

It is well known for lubricating oils to contain a number of surface active additives (including antiwear agents, dispersants, or detergents) used to protect internal combustion engines from corrosion, wear, soot deposits and acid build up. Often, such surface active additives can have harmful effects on engine component wear (in both iron and aluminium based components), bearing corrosion or fuel economy. A common antiwear additive for engine lubricating oils is zinc dialkyldithiophosphate (ZDDP). It is believed that ZDDP antiwear additives protect the engine by forming a protective film on metal surfaces. ZDDP may also have a detrimental impact on fuel economy and efficiency and copper corrosion. Consequently, engine lubricants may also contain a friction modifier to obviate the detrimental impact of ZDDP on fuel economy and corrosion inhibitors to obviate the detrimental impact of ZDDP on copper corrosion. Other additives may also increase lead corrosion.

Developments in engine design have resulted in engines that employ iron-containing and/or non-ferric components. Typically non-ferric engine components thereof are based on aluminium-alloy, silicates, oxides, or other ceramic materials. Antiwear additives such as ZDDP is believed to result in poorer engine wear performance in aluminium-alloy based engine compared with ferric based engines.

Further, engine lubricants containing phosphorus compounds and sulphur have been shown to contribute in part to particulate emissions and emissions of other pollutants. In addition, sulphur and phosphorus tend to poison the catalysts used in catalytic converters, resulting in a reduction in performance of said catalysts.

In light of the move to more strict emissions standards and the deleterious effects of certain elements, there is a desire for reduced amounts of sulphur, phosphorus and sulphated ash in engine oils. Consequently, the amounts of phosphorus-containing antiwear agents such as ZDDP, overbased detergents such as calcium or magnesium sulphonates and phenates have been reduced. As a consequence, ashless additives such as esters of polyhydric alcohols or hydroxyl containing acids including glycerol monooleate have been contemplated to provide friction performance.

Canadian Patent CA 1 183 125 (by Barrer, filed Sep. 10, 1981) discloses lubricants for gasoline engines containing alkyl-ester tartrates, where the sum of carbon atoms on the alkyl groups is at least 8. The tartrates are disclosed as antiwear agents. Other references disclosing tartrates and/or tartrimides include International Publication WO 2006/044411, and US Patent Applications for internal combustion engines requiring reduced amounts of sulphur, sulphated ash, and phosphorus. The lubricant composition has antiwear or anti-fatigue properties. The lubricating compositions are suitable for road vehicles.

U.S. Pat. No. 4,237,022 (by Barrer, filed Dec. 2, 1980) discloses tartrimides useful as additives in lubricants and fuels for effective reduction in squeal and friction as well as improvement in fuel economy.

U.S. Pat. No. 5,338,470 (by Hiebert, filed Dec. 10, 1992) and International Publication WO 2005/087904 (by Migdal, filed Mar. 11, 2004) disclose lubricants containing at least one hydroxycarboxylic acid ester or hydroxy polycarboxylic acid (in particular citrates or ethyl glycolate). The lubricant composition has anti-wear or anti-fatigue properties.

International Application WO2008/070307 (by Brown, filed Oct. 22, 2007) discloses engine lubricants containing antiwear agents based on malonate esters.

SUMMARY OF THE INVENTION

The inventors of this invention have discovered a lubricating composition that is capable of providing at least one of antiwear, or friction modification (particularly for enhancing fuel economy).

As used herein reference to the amounts of additives present in the lubricating composition disclosed herein are quoted on an oil free basis i.e., amount of actives.

In one embodiment the present invention provide a lubricating composition comprising (a) an oil of lubricating viscosity, (b) a phosphite having at least one hydrocarbyl group that has 4 or more, or 8 or more, or 12 or more carbon atoms, and (c) a compound derived from a hydroxy-carboxylic acid.

In one embodiment the invention provides a lubricating composition wherein the phosphite having at least one hydrocarbyl group with 4 or more carbon atoms and the compound derived from the hydroxy-carboxylic acid may both present in an amount in the range of:

(i) 0.01 wt % to 5 wt % and 0.01 wt % to 5 wt % respectively, or
(ii) 0.1 wt % to 3 wt % and 0.1 wt % to 3 wt % respectively, or
(iii) 0.2 wt % to 1.5 wt % and 0.2 wt % to 1.5 wt % respectively, or
(iv) 0.25 wt % to 1 wt % and 0.25 wt % to 1 wt % respectively, or
(v) 0.5 wt % to 1 wt % and 0.5 wt % to 1 wt % respectively of the lubricating composition.

In one embodiment the present invention provide a lubricating composition comprising (a) an oil of lubricating viscosity, (b) a phosphite having at least one hydrocarbyl group that has 4 or more, or 8 or more, or 12 or more carbon atoms, (c) a compound derived from a hydroxy-carboxylic acid, and (d) a zinc dialkyldithiophosphate, wherein the phosphite delivers at least 0.01 wt % to 0.12 wt %, or 0.01 wt % to 0.08 wt % of phosphorus to the lubricating composition.

In one embodiment the phosphite having at least one hydrocarbyl group with 4 or more carbon atoms and the compound derived from the hydroxy-carboxylic acid may both be present in an amount in the range of 0.5 wt % to 1 wt % and 0.5 wt % to 1 wt % respectively of the lubricating composition.

In one embodiment the invention provides a method of lubricating an internal combustion engine comprising supplying to the internal combustion engine a lubricating composition as disclosed herein.

In one embodiment the invention provides a method of lubricating an internal combustion engine as disclosed herein, wherein the internal combustion engine has surfaces of an aluminium alloy, or aluminium composite In one embodiment the invention provides a method of lubricating an internal combustion engine as disclosed herein, wherein the aluminium alloy is an eutectic or hypereutectic aluminium alloy (such as those derived from aluminium silicates, aluminium oxides, or other ceramic materials).

In one embodiment the method of lubricating an internal combustion engine as disclosed herein, wherein the internal combustion engine has surfaces of steel.

In one embodiment the invention provides a method of lubricating an internal combustion engine as disclosed herein, wherein the internal combustion engine has a cylinder bore, cylinder block, or piston ring having an aluminium alloy, aluminium composite or iron surface.

In one embodiment the invention provides for the use of a lubricant to provide at least one of wear protection, and/or fuel economy (reduced friction modification properties) to an aluminium based surface (particularly an internal combustion engine aluminium based surface) wherein the lubricating composition comprises (a) an oil of lubricating viscosity, (b) a phosphite having at least one hydrocarbyl group that has 4 or more, or 8 or more, or 12 or more carbon atoms, and (c) a compound derived from a hydroxy-carboxylic acid.

In one embodiment the invention provides for the use of a lubricant to provide wear protection, to a metal surface (may be iron or aluminium based, typically aluminium based) of an internal combustion engine, wherein the lubricating composition comprises (a) an oil of lubricating viscosity, (b) a phosphite having at least one hydrocarbyl group that has 4 or more, or 8 or more, or 12 or more carbon atoms, and (c) a compound derived from a hydroxy-carboxylic acid.

DETAILED DESCRIPTION OF THE INVENTION

The present invention provides a lubricating composition and a method for lubricating an engine as disclosed above.

Compound Derived from Hydroxy-Carboxylic Acid

The invention provides a lubricating composition containing a compound derived from a hydroxy-carboxylic acid. The compound derived from a hydroxy-carboxylic acid may be represented by the formula:

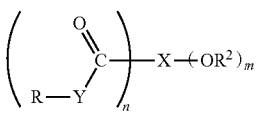

wherein n and m may be independently integers of 1 to 5;

X may be an aliphatic or alicyclic group, or an aliphatic or alicyclic group containing an oxygen atom in the carbon chain, or a substituted group of the foregoing types, said group containing up to 6 carbon atoms and having n+m available points of attachment; each Y may be independently —O—, >NH, or >$NR^1$ or two Ys together may represent the nitrogen of an imide structure R—N< formed between two carbonyl groups; and each R and $R^1$ may be independently hydrogen or a hydrocarbyl group, provided that at least one R or $R^1$ group is a hydrocarbyl group; each $R^2$ may be independently hydrogen, a hydrocarbyl group or an acyl group, further provided that at least one —$OR^2$ group is located on a carbon atom within X that is α or β to at least one of the —C(O)—Y—R groups.

The compound derived from the hydroxy-carboxylic acid may be derived from glycolic acid (n and m both equal 1), malic acid (n=2, m=1), tartaric acid (n and m both equal 2), citric acid (n=3, m=1), or mixtures thereof. In one embodiment the compound derived from the hydroxy-carboxylic acid may be derived from tartaric acid.

The compound derived from the hydroxy-carboxylic acid may be an amide, ester or imide derivative of a hydroxy-carboxylic acid, or mixtures thereof. In one embodiment the compound derived from the hydroxy-carboxylic acid may be an amide, ester or imide derivative of a hydroxy-carboxylic acid. For example an ester or imide of tartaric acid.

In one embodiment the compound derived from the hydroxy-carboxylic acid may be at least one of a hydroxy-carboxylic acid di-ester, a hydroxy-carboxylic acid di-amide, a hydroxy-carboxylic acid di-imide, a hydroxy-carboxylic acid mono-imide, a hydroxy-carboxylic acid ester-amide, a hydroxy-carboxylic acid ester-imide, and a hydroxy-carboxylic acid imide-amide. In one embodiment the amide, ester or imide derivative of a hydroxy-carboxylic acid may derived from at least one of the group consisting of a hydroxy-carboxylic acid di-ester, a hydroxy-carboxylic acid di-amide, a hydroxy-carboxylic acid mono-imide, and a hydroxy-carboxylic acid ester-amide.

Each R, $R^1$ and $R^2$ group of the compound derived from the hydroxy-carboxylic acid may be a linear or branched alkyl groups each having 1 to 150, or 8 to 30, or 8 to 20 carbon atoms). The ester derivatives of the hydroxy-carboxylic acid may be formed by the reaction of an alcohol with hydroxy-carboxylic acid. The alcohol includes both monohydric alcohol and polyhydric alcohol. The carbon atoms of the alcohol may be linear chains, branched chains, or mixtures thereof.

Examples of a suitable branched alcohol include 2-ethylhexanol, iso-tridecanol, iso-octyl, Guerbet alcohols, or mixtures thereof.

Examples of a monohydric alcohol include methanol, ethanol, propanol, butanol, pentanol, hexanol, heptanol, octanol, nonanol, decanol, undecanol, dodecanol, tridecanol, tetradecanol, pentadecanol, hexadecanol, heptadecanol, octadecanol, nonadecanol, eicosanol, or mixtures thereof. In one embodiment the monohydric alcohol contains 8 to 20 carbon atoms.

In one embodiment the imide derivatives of a hydroxy-carboxylic acid may be tartrimides, typically containing 8 to 20 carbon atoms. Amines used to prepare imides may include alkyl amines (such as n-hexylamine (caproylamine), n-octylamine (caprylylamine), n-decylamine (caprylamine), n-dodecylamine (laurylamine), n-tetradecyl amine (myristylamine), n-pentadecylamine, n-hexadecylamine (palmitylamine), margarylamine, n-octadecylamine (stearylamine)), unsaturated amines (such as dodecenylamine, myristoleylamine, palmitoleylamine, oleylamine, and linoleylamine), or etheramines (such as those identified as SURFAM™ P14AB (branched C14), SURFAM™ P16A (linear C16), and SURFAM™ P17AB (branched C17)). A detailed description of methods for preparing suitable tartrimides (by reacting tartaric acid with a primary amine) is disclosed in U.S. Pat. No. 4,237,022.

U.S. Patent Applications 60/939,949 (filed May 24, 2007; now WO 2008/147704) and 60/939,952 (filed May 24, 2007; now US 2010-0093573) disclose in more detail useful hydroxycarboxylic acid compounds for the present invention.

Canadian Patent 1 183 125; US Patent Publication numbers 2006/0183647 and US-2006-0079413; U.S. Patent Application No. 60/867,402 (now WO2008/067249); and British Patent 2 105 743 A, all disclose useful examples of suitable tartaric acid derivatives.

The compound derived from the hydroxy-carboxylic acid may be present at 0.01 wt % to 5 wt %, or 0.1 wt % to 3 wt %, or 0.2 wt % to 1.5 wt %, or 0.25 wt % to 1 wt %, or 0.5 wt % to 1 wt % of the lubricating composition.

Phosphite

The invention provides a lubricating composition containing a phosphite having at least one hydrocarbyl group with 4 or more, or 8 or more, or 12 or more, carbon atoms. Typical ranges for the number of carbon atoms on the hydrocarbyl group include 8 to 30, or 10 to 24, or 12 to 22, or 14 to 20, or 16 to 18. The phosphite may be a monohydrocarbyl substituted phosphite, a di-hydrocarbyl substituted phosphite, or a tri-hydrocarbyl substituted phosphite.

In one embodiment the phosphite is sulphur-free i.e., the phosphite is not a thiophosphite.

The phosphite having at least one hydrocarbyl group with 4 or more carbon atoms may be represented by the formulae:

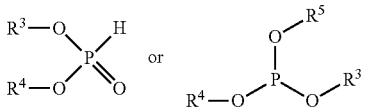

wherein at least one of $R^3$, $R^4$ and $R^5$ may be a hydrocarbyl group containing at least 4 carbon atoms and the other may be hydrogen or a hydrocarbyl group. In one embodiment both $R^3$, $R^4$ and $R^5$ are hydrocarbyl groups. The hydrocarbyl groups may be alkyl, cycloalkyl, aryl, acyclic or mixtures thereof. In the formula with all three groups $R^3$, $R^4$ and $R^5$, the compound may be a tri-hydrocarbyl substituted phosphite i.e., $R^3$, $R^4$ and $R^5$ are all hydrocarbyl groups.

Alkyl groups may be linear or branched, typically linear, and saturated or unsaturated, typically saturated. Examples of alkyl groups for $R^3$, $R^4$ and $R^5$ include octyl, 2-ethylhexyl, nonyl, decyl, undecyl, dodecyl, tridecyl, tetradecyl, pentadecyl, hexadecyl, heptadecyl, octadecyl, octadecenyl, nonodecyl, eicosyl or mixtures thereof.

The phosphite having at least one hydrocarbyl group with 4 or more, carbon atoms may be present at 0.01 wt % to 5 wt %, or 0.1 wt % to 3 wt %, or 0.2 wt % to 1.5 wt %, or 0.25 wt % to 1 wt %, or 0.5 wt % to 1 wt % of the lubricating composition.

Oils of Lubricating Viscosity

The lubricating composition comprises an oil of lubricating viscosity0 Such oils include natural and synthetic oils, oil derived from hydrocracking, hydrogenation, and hydrofinishing, unrefined, refined, re-refined oils or mixtures thereof. A more detailed description of unrefined, refined and re-refined oils is provided in International Publication WO2008/147704, paragraphs [0054] to [0056]. A more detailed description of natural and synthetic lubricating oils is described in paragraphs [0058] to [0059] respectively of WO2008/147704. Synthetic oils may also be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in April 2008 version of "Appendix E-API Base Oil Interchangeability Guidelines for Passenger Car Motor Oils and Diesel Engine Oils", section 1.3 Sub-heading 1.3. "Base Stock Categories". In one embodiment the oil of lubricating viscosity may be an API Group I, or Group II, or Group III, or Group IV oil. In one embodiment the oil of lubricating viscosity may be an API Group II or Group III oil. In one embodiment the oil of lubricating viscosity may be a hydrocracked or severely hydrocracked base stock and/or an API Group II or Group III oil.

The amount of the oil of lubricating viscosity present is typically the balance remaining after subtracting from 100 wt % the sum of the amount of the compound of the invention and the other performance additives.

The lubricating composition may be in the form of a concentrate and/or a fully formulated lubricant. If the lubricating composition of the invention (comprising the additives disclosed herein) is in the form of a concentrate which may be combined with additional oil to form, in whole or in part, a finished lubricant), the ratio of the of these additives to the oil of lubricating viscosity and/or to diluent oil include the ranges of 1:99 to 99:1 by weight, or 80:20 to 10:90 by weight.

Other Performance Additives

The composition optionally comprises other performance additives. The other performance additives include at least one of metal deactivators, viscosity modifiers, detergents, friction modifiers, antiwear agents, corrosion inhibitors, dispersants, dispersant viscosity modifiers, extreme pressure agents, antioxidants, foam inhibitors, demulsifiers, pour point depressants, seal swelling agents and mixtures thereof. Typically, fully-formulated lubricating oil will contain one or more of these performance additives.

In one embodiment the lubricating composition further includes other additives. In different embodiments the lubricating composition may have a composition as described in the following table:

| | Embodiments (wt %) | | |
|---|---|---|---|
| Additive | A | B | C |
| Compound[1] | 0.01 to 5 | 0.1 to 3 | 0.2 to 1.5 |
| Phosphite[2] | 0.01 to 5 | 0.1 to 3 | 0.2 to 1.5 |
| Dispersant | 0.05 to 12 | 0.75 to 8 | 0.5 to 6 |
| Dispersant Viscosity Modifier | 0 to 5 | 0 to 4 | 0.05 to 2 |
| Overbased Detergent | 0 to 15 | 0.1 to 10 | 0.2 to 8 |
| Antioxidant | 0 to 15 | 0.1 to 10 | 0.5 to 5 |
| Antiwear Agent | 0 to 15 | 0.1 to 10 | 0.3 to 5 |
| Friction Modifier | 0 to 6 | 0.05 to 4 | 0.1 to 2 |
| Viscosity Modifier | 0 to 10 | 0.5 to 8 | 1 to 6 |
| Any Other Performance Additive | 0 to 10 | 0 to 8 | 0 to 6 |
| Oil of Lubricating Viscosity | Balance to 100% | Balance to 100% | Balance to 100% |

Footnote:

[1]Compound is described above as a compound derived from a hydroxy-carboxylic acid.

[2]Phosphite is described above having at least one hydrocarbyl group with 4 or more carbon atoms.

In one embodiment the invention provides a lubricating composition further comprising at least one of a dispersant, an antiwear agent, a dispersant viscosity modifier, a friction modifier, a viscosity modifier, an antioxidant, an overbased detergent, or mixtures thereof.

The dispersant of the present invention may be a succinimide dispersant, or mixtures thereof. In one embodiment the dispersant may be present as a single dispersant. In one embodiment the dispersant may be present in a mixture of two or three different dispersants, wherein at least one may be a succinimide dispersant.

The succinimide dispersant may be derived from an aliphatic polyamine, or mixtures thereof. The aliphatic polyamine may be aliphatic polyamine such as an ethylenepolyamine, a propylenepolyamine, a butylenepolyamine, or mixtures thereof. In one embodiment the aliphatic polyamine may be ethylenepolyamine. In one embodiment the aliphatic polyamine may be selected from the group consisting of ethylenediamine, diethylenetriamine, triethylenetetramine, tetraethylenepentamine, pentaethylenehexamine, polyamine still bottoms, and mixtures thereof.

The dispersant may be an N-substituted long chain alkenyl succinimide. Examples of N-substituted long chain alkenyl succinimide include polyisobutylene succinimide. Typically the polyisobutylene from which the polyisobutylene succinic anhydride is derived has a number average molecular weight of 350 to 5000, or 550 to 3000 or 750 to 2500. Succinimide dispersants and their preparation are disclosed, for instance in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and U.S. Pat. Nos. 6,165,235, 7,238,650 and EP Patent Application 0 355 895 A.

The dispersant may also be post-treated by conventional methods by a reaction with any of a variety of agents. Among these are boron compounds, urea, thiourea, dimercaptothiadiazoles, carbon disulphide, aldehydes, ketones, carboxylic acids, hydrocarbon-substituted succinic anhydrides, maleic anhydride, nitriles, epoxides, and phosphorus compounds.

The dispersant may be present at 0.01 wt % to 20 wt %, or 0.1 wt % to 15 wt %, or 0.1 wt % to 10 wt %, or 1 wt % to 6 wt % of the lubricating composition.

In one embodiment the lubricating composition of the invention further comprises a dispersant viscosity modifier. The dispersant viscosity modifier may be present at 0 wt % to 5 wt %, or 0 wt % to 4 wt %, or 0.05 wt % to 2 wt % of the lubricating composition.

The dispersant viscosity modifier may include functionalised polyolefins, for example, ethylene-propylene copolymers that have been functionalized with an acylating agent such as maleic anhydride and an amine; polymethacrylates functionalised with an amine, or styrene-maleic anhydride copolymers reacted with an amine. More detailed description of dispersant viscosity modifiers are disclosed in International Publication WO2006/015130 or U.S. Pat. Nos. 4,863,623; 6,107,257; 6,107,258; and 6,117,825. In one embodiment the dispersant viscosity modifier may include those described in U.S. Pat. No. 4,863,623 (see column 2, line 15 to column 3, line 52) or in International Publication WO2006/015130 (see page 2, paragraph [0008] and preparative examples are described paragraphs [0065] to [0073]).

In one embodiment the friction modifier may be selected from the group consisting of long chain fatty acid derivatives of amines, long chain fatty esters, or long chain fatty epoxides; fatty imidazolines; amine salts of alkylphosphoric acids. The friction modifier may be present at 0 wt % to 6 wt %, or 0.05 wt % to 4 wt %, or 0.1 wt % to 2 wt % of the lubricating composition In one embodiment the invention provides a lubricating composition which further includes a zinc dialkyldithiophosphate, or mixtures thereof. Zinc dialkyldithiophosphates are known in the art. The antiwear agent may be present at 0 wt % to 15 wt %, or 0.1 wt % to 10 wt %, or 0.1 wt % to 5 wt %, or 0.5 wt % to 2 wt %, or 0.75 wt % to 1.5 wt % of the lubricating composition. In one embodiment the invention provides a lubricating composition further including a zinc dialkyldithiophosphate present at 0 wt % to 0.05 wt %, or 0.01 wt % to 0.05 wt %.

In one embodiment the invention provides a lubricating composition further comprising a molybdenum compound. The molybdenum compound may be selected from the group consisting of molybdenum dialkyldithiophosphates, molybdenum dithiocarbamates, amine salts of molybdenum compounds, and mixtures thereof. The molybdenum compound may provide the lubricating composition with 0 to 1000 ppm, or 5 to 1000 ppm, or 10 to 750 ppm 5 ppm to 300 ppm, or 20 ppm to 250 ppm of molybdenum.

In one embodiment the invention provides a lubricating composition further comprising an overbased detergent. The overbased detergent may be selected from the group consisting of non-sulphur containing phenates, sulphur containing phenates, sulphonates, salixarates, salicylates, and mixtures thereof. Typically an overbased detergent may be a sodium, calcium or magnesium salt of the phenates, sulphur containing phenates, sulphonates, salixarates and salicylates. Overbased phenates and salicylates, typically have a total base number of 180 to 450 TBN. Overbased sulphonates typically have a total base number of 250 to 600, or 300 to 500. Overbased detergents are known in the art. In one embodiment the sulphonate detergent may be a predominantly linear alkylbenzene sulphonate detergent having a metal ratio of at least 8 as is described in paragraphs [0026] to [0037] of US Patent Application 2005065045 (and granted as U.S. Pat. No. 7,407,919). The predominantly linear alkylbenzene sulphonate detergent may be particularly useful for assisting in improving fuel economy. Overbased detergents are known in the art. The overbased detergent may be present at 0 wt % to 15 wt %, or 0.1 wt % to 10 wt %, or 0.2 wt % to 8 wt % of the lubricating composition.

In one embodiment the lubricating composition includes an antioxidant, or mixtures thereof. The antioxidant may be present at 0 wt % to 15 wt 5, or 0.1 wt % to 10 wt %, or 0.5 wt % to 5 wt % of the lubricating composition.

Antioxidants include sulphurised olefins, alkylated diphenylamines (typically dinonyl diphenylamine, octyl diphenylamine, dioctyl diphenylamine), hindered phenols, molybdenum compounds (such as molybdenum dithiocarbamates), or mixtures thereof.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 from Ciba. A more detailed description of suitable ester-containing hindered phenol antioxidant chemistry is found in U.S. Pat. No. 6,559,105.

Examples of suitable friction modifiers include long chain fatty acid derivatives of amines, alcohols, esters, or epoxides; fatty imidazolines such as condensation products of carboxylic acids and polyalkylene-polyamines; amine salts of alkylphosphoric acids; or a variety of fatty alkyl tartrates; fatty alkyl tartrimides; or fatty alkyl tartramides that are in addition to the compound derived from the hydroxy-carboxylic acid as described by the present invention.

Friction modifiers may also encompass materials such as sulphurised fatty compounds and olefins, molybdenum dialkyldithiophosphates, molybdenum dithiocarbamates, sunflower oil, or monoester of a polyol and an aliphatic carboxylic acid such as glycerol mono-oleate (GMO).

In one embodiment the friction modifier may be selected from the group consisting of long chain fatty acid derivatives of amines, esters, or epoxides; fatty alkyl tartrates; fatty alkyl tartrimides; and fatty alkyl tartramides. The fatty alkyl tartrates; fatty alkyl tartrimides; and fatty alkyl tartramides may be the same or different from the amide, ester or imide derivative of a hydroxy-carboxylic acid described above.

In one embodiment the friction modifier may be a long chain fatty acid ester. In another embodiment the long chain fatty acid ester may be a mono-ester and in another embodiment the long chain fatty acid ester may be a (tri)glycerides.

Other performance additives such as corrosion inhibitors include those described in paragraphs 5 to 8 of U.S. application Ser. No. 05/038,319, published as WO2006/047486, octylamine octanoate, condensation products of dodecenyl succinic acid or anhydride and a fatty acid such as oleic acid with a polyamine. In one embodiment the corrosion inhibitors include the Synalox® corrosion inhibitor. The Synalox® corrosion inhibitor may be a homopolymer or copolymer of propylene oxide. The Synalox® corrosion inhibitor is described in more detail in a product brochure with Form No. 118-01453-0702 AMS, published by The Dow Chemical Company. The product brochure is entitled "SYNALOX Lubricants, High-Performance Polyglycols for Demanding Applications."

Metal deactivators including derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including silicon-containing polymers, copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides may be useful. Foam inhibitors that may be useful in the compositions of the invention include copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers.

Pour point depressants that may be useful in the compositions of the invention include polyalphaolefins, esters of maleic anhydride-styrene, poly(meth)acrylates, polyacrylates or polyacrylamides.

Industrial Application

The lubricating composition may be utilised in an internal combustion engine. The internal combustion engine may or may not have an Exhaust Gas Recirculation system. The internal combustion engine may be fitted with an emission control system or a turbocharger. Examples of the emission control system include diesel particulate filters (DPF), or systems employing selective catalytic reduction (SCR).

In one embodiment the internal combustion engine may be a diesel fuelled engine (typically a heavy duty diesel engine), a gasoline fuelled engine, a natural gas fuelled engine or a mixed gasoline/alcohol fuelled engine. In one embodiment the internal combustion engine may be a diesel fuelled engine and in another embodiment a gasoline fuelled engine.

The internal combustion engine may be a 2-stroke or 4-stroke engine. Suitable internal combustion engines include marine diesel engines, aviation piston engines, low-load diesel engines, and automobile and truck engines.

The lubricant composition for an internal combustion engine may be suitable for any engine lubricant irrespective of the sulphur, phosphorus or sulphated ash (ASTM D-874) content. The sulphur content of the engine oil lubricant may be 1 wt % or less, or 0.8 wt % or less, or 0.5 wt % or less, or 0.3 wt % or less. In one embodiment the sulphur content may be in the range of 0.001 wt % to 0.5 wt %, or 0.01 wt % to 0.3 wt %. The phosphorus content may be 0.2 wt % or less, or 0.12 wt % or less, or 0.1 wt % or less, or 0.085 wt % or less, or 0.08 wt % or less, or even 0.06 wt % or less, 0.055 wt % or less, or 0.05 wt % or less. In one embodiment the phosphorus content may be 100 ppm to 1000 ppm, or 200 ppm to 600 ppm. The total sulphated ash content may be 2 wt % or less, or 1.5 wt % or less, or 1.1 wt % or less, or 1 wt % or less, or 0.8 wt % or less, or 0.5 wt % or less, or 0.4 wt % or less. In one embodiment the sulphated ash content may be 0.05 wt % to 0.9 wt %, or 0.1 wt % to 0.2 wt % or to 0.45 wt %.

In one embodiment the lubricating composition may be an engine oil, wherein the lubricating composition may be characterised as having at least one of (i) a sulphur content of 0.5 wt % or less, (ii) a phosphorus content of 0.1 wt % or less, and (iii) a sulphated ash content of 1.5 wt % or less.

The following examples provide illustrations of the invention. These examples are non-exhaustive and are not intended to limit the scope of the invention.

EXAMPLES

Lubricant Example 1 (EX1)

is a SAE 5W-30 engine lubricant containing a mixture of detergents (including calcium sulphonate and calcium phenate), a succinimide dispersant, 0.5 wt % of 2-ethylhexyl tartrate, 0.5 wt % of zinc dialkyldithiophosphate, and 0.5 wt % of a $C_{16-18}$ dialkyl phosphite.

Comparative Example 1 (CE1)

is a SAE 5W-30 engine lubricant similar to EX1, except it contains 0.5 wt % 2-ethylhexyl tartrate and 0.5 wt % of zinc dialkyldithiophosphate (i.e., no $C_{16-18}$ dialkyl phosphite). CE1 is similar to example 21 of WO 2005/087904, except 2-ethylhexyl tartrate has been employed rather than butyl tartrate (as is exemplified in example 21).

Comparative Example 2 (CE2)

is a SAE 5W-30 engine lubricant similar to EX1, except it contains 1 wt % of 2-ethylhexyl tartrate and 0.5 wt % of zinc dialkyldithiophosphate (i.e., no $C_{16-18}$ dialkyl phosphite).

Comparative Example 3 (CE3)

is a SAE 5W-30 engine lubricant similar to EX1, except it contains 0.5 wt % of $C_{16-18}$ dialkyl phosphite and 0.5 wt % of zinc dialkyldithiophosphate (i.e., no 2-ethylhexyl tartrate).

Comparative Example 4 (CE4)

is a SAE 5W-30 engine lubricant similar to EX1, except it contains 1 wt % of $C_{16-18}$ dialkyl phosphite and 0.5 wt % of zinc dialkyldithiophosphate (i.e., no 2-ethylhexyl tartrate).

Comparative Example 5 (CE5)

is a SAE 5W-30 engine lubricant similar to EX1, except it contains 0.5 wt % of zinc dialkyldithiophosphate (i.e., no 2-ethylhexyl tartrate and no $C_{16-18}$ dialkyl phosphite).

Test: HFRR Wear

The SAE 5W-30 lubricants are evaluated for wear in a programmed temperature high frequency reciprocating rig (HFRR) available from PCS Instruments. HFRR conditions for the evaluations were 500 g load, 75 minute duration, 1000 micrometer stroke, 20 Hertz frequency, and temperature profile of 15 minutes at 40° C. followed by an increase in temperature to 160° C. at a rate of 2° C. per minute. The upper test piece was a 6 mm diameter steel ball (ANSI E-52100, Rockwell 'C' hardness 58-66 and a surface finish of Ra<0.05 μm), the lower test specimen was either a flat steel disc (ANSI E-52100, Vickers "HV30" hardness 190-210 and a surface finish of Ra<0.02 μm) or an aluminium specimen of similar size. Both the upper and lower specimens are available together from PCS Instruments (Part Number HFRSSP). The wear scar data obtained for aluminium based engine component is measured and presented in the following table:

| | EX1 | CE1 | CE2 | CE3 | CE4 | CE5 |
|---|---|---|---|---|---|---|
| Wear Scan (microns) | 172 | 207 | 213 | 255 | 227 | 274 |

Overall the data presented indicates that the lubricating composition of the invention (for example, an internal combustion engine lubricant) provides improved antiwear performance compared with the comparative example lubricants. The data demonstrates the improved performance for an internal combustion engine having an aluminium-based surface.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the sub stituent; and hetero sub stituents, that is, substituents which similarly have a predominantly hydrocarbon character but contain other than carbon in a ring or chain. A more detailed definition of the term "hydrocarbyl substituent" or "hydrocarbyl group" is described in paragraphs [0118] to [0119] of International Publication WO2008147704.

As used herein the term "fatty" as in fatty acid (and other expressions used herein) is includes a hydrocarbyl chain containing 4 to 150, or 4 to 30, or 6 to 16 carbon atoms.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricating composition comprising (a) an oil of lubricating viscosity, (b) 0.5 wt % to 1.0 wt % of a phosphite having at least one hydrocarbyl group that has 4 or more carbon atoms, wherein the phosphite having at least one hydrocarbyl group with 4 or more is represented by the formula:

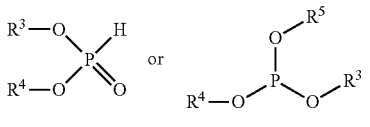

wherein at least one of $R^3$, $R^4$ and $R^5$ is a hydrocarbyl group containing from at least 4 carbon atoms and the other may be hydrogen or a hydrocarbyl group, and wherein the phosphite has at least one hydrocarbyl group with 16 to 18 carbon atoms, and (c) 0.1 wt % to 0.5 wt % of a compound derived from an ester of a hydroxy-carboxylic acid having linear or branched alkyl groups of 1 to 20 carbon atoms and selected from the group consisting of malic acid, citric acid, or mixtures thereof; and (d) an overbased magnesium sulphonate detergent having a TBN of from 250 to 600 present in an amount from about 0.2 wt % to about 8 wt %;

wherein the lubricating composition is characterised as having (i) a sulphur content of 0.5 wt % or less, (ii) a phosphorus content of 0.1 wt % or less, and (iii) a sulphated ash content of 1.5 wt % or less.

2. The lubricating composition of claim 1, wherein n and m both equal 2.

3. The lubricating composition of claim 1, wherein both $R^3$ and $R^4$ are hydrocarbyl groups.

4. The lubricating composition of claim 1 further comprising a zinc dialkyldithiophosphate, or mixtures thereof, wherein the zinc dialkyldithiophosphate is present at 0.75 wt % to 1.5 wt % of the lubricating composition.

5. The lubricating composition of claim 1 further comprising at least one of an antiwear agent, a dispersant viscosity modifier, a friction modifier, a viscosity modifier, an antioxidant, an overbased detergent, or mixtures thereof.

6. A method of lubricating an internal combustion engine comprising supplying to the internal combustion engine the lubricating composition of claim 1.

7. The method of claim 6, wherein the internal combustion engine has surfaces of an aluminium alloy, or aluminium composite.

8. The method of claim 7, wherein the aluminium alloy is a eutectic or hyper-eutectic aluminium alloy.

9. The method of claim 8, wherein the aluminium alloy is derived from an aluminium silicate.

10. The method of claim 6, wherein the internal combustion engine has surfaces of steel.

11. The method of claim 1, wherein the compound is derived from malic acid.

12. The method of claim 1, wherein the compound is derived from citric acid.

13. The method of claim 1, wherein the lubricating composition is free of zinc dialkyldithiophosphate.

* * * * *